US006854212B2

(12) United States Patent
Engelgau et al.

(10) Patent No.: US 6,854,212 B2
(45) Date of Patent: Feb. 15, 2005

(54) BELT DRIVE SYSTEM FOR SLIDING VEHICLE DOOR

(75) Inventors: Steven John Engelgau, Royal Oak, MI (US); Shelley Lynn Bess, Royal Oak, MI (US); Christopher Matthew Radjewski, Sterling Heights, MI (US); Ian Christopher Hoare, West Bloomfield, MI (US); Joseph Allen Wilbanks, II, Hermitage, TN (US); Rajesh J. Somnay, Troy, MI (US); Silvio M. Yamada, Waterford, MI (US)

(73) Assignee: ArvinMeritor Technology, LLC., Troy, MI (US)

( * ) Notice: Subject to any disclaimer, the term of this patent is extended or adjusted under 35 U.S.C. 154(b) by 0 days.

(21) Appl. No.: 10/382,682

(22) Filed: Mar. 6, 2003

(65) Prior Publication Data

US 2004/0172884 A1 Sep. 9, 2004

(51) Int. Cl.[7] ..... E05F 11/54
(52) U.S. Cl. ..... 49/360; 49/358
(58) Field of Search ..... 49/360, 324, 325, 49/358, 213; 474/148; 74/417

(56) References Cited

U.S. PATENT DOCUMENTS 650,796 A * 5/1900 Rhine ..... 280/261
4,168,758 A * 9/1979 Holt ..... 180/206
4,462,185 A * 7/1984 Shibuki et al. ..... 49/218
4,887,390 A * 12/1989 Boyko et al. ..... 49/214
5,536,061 A * 7/1996 Moore et al. ..... 296/155
5,551,190 A * 9/1996 Yamagishi et al. ..... 49/360
5,992,919 A * 11/1999 Menke ..... 296/155
6,036,257 A 3/2000 Manuel
6,038,818 A 3/2000 Haag et al.
6,079,767 A 6/2000 Faubert et al.
6,100,619 A 8/2000 Buscher et al.
6,125,583 A * 10/2000 Murray et al. ..... 49/291
6,135,513 A 10/2000 Hamada et al.
6,276,743 B1 * 8/2001 Jyawook et al. ..... 296/155
6,290,283 B1 9/2001 Fukumoto et al.
6,321,488 B1 * 11/2001 Bigoszewski et al. ..... 49/358
6,397,523 B1 6/2002 Fukumoto et al.
6,412,222 B1 7/2002 Hashiba et al.
6,418,668 B1 7/2002 Arquevaux
6,430,875 B1 8/2002 Clark et al.
6,530,619 B2 * 3/2003 Fukumoto et al. ..... 296/155
2003/0140563 A1 * 7/2003 Oberheide ..... 49/360

FOREIGN PATENT DOCUMENTS

JP 58-30828 * 2/1983

* cited by examiner

*Primary Examiner*—Gregory J. Strimbu
(74) *Attorney, Agent, or Firm*—Carlson, Gaskey & Olds

(57) ABSTRACT

A drive system drives a pulley along a curved track to open and close a sliding vehicle door. The pulley is pivotally mounted to the sliding door to permit the pulley to pivot when the pulley traverses the curved portion of the track. An electric motor drives the pulley through a drive belt. In operation, as the pulley pivots when it traverses the curved portion of the track, the drive belt twists. Torque transfer between the pulleys and the motor is maintained during twisting of the drive belt which thereby permits an uncomplicated yet effective system for driving the sliding door along the curved portion of track. Another drive system transmits torque through a drive shaft arrangement which rotates as the drive system traverses the curved portion of track.

14 Claims, 3 Drawing Sheets

BELT DRIVE SYSTEM FOR SLIDING VEHICLE DOOR

BACKGROUND OF THE INVENTION

The present invention relates to a sliding vehicle door, and more particularly to a power operated drive system therefore.

In various types of vehicles, it is known to provide a sliding door where the door moves along a fixed path generally parallel to a side wall of the vehicle. Typically, the sliding door moves generally into the plane of the door opening during a portion of its respective final closing and initial opening movements. Movement into the plane of the door opening allows the sliding door to be flush with the side wall when fully closed. Movement out of the plane of the door opening during its initial opening movement allows the sliding door to be along side of, and parallel to, the side wall of the vehicle.

Guide rails or tracks are commonly attached to the top and bottom portions of the door opening to guide the sliding door. Typically, end portions of the various guide rails are curved inwardly with respect to the vehicle body to provide the out of plane movement. Roller assemblies are fastened to the respective upper and lower forward ends of the sliding door for movement along the guide rails to guide the door through its opening and closing movements.

Movement of the sliding door generally parallel to the side wall of the vehicle requires high displacement with low force to achieve the transitional movement since only frictional resistance and gravity resistances due to changes in grade must be overcome. Movement of the sliding door through the curved guide rail track requires low displacement with high force. As an elastomeric weather seal surrounding the door opening must be overcome and an unlatched striker must be engaged to lock the sliding door.

During manual operation, sliding van doors are typically moved with great momentum through the entire closing movement in order to ensure full weather strip compression and latch operation at the end of such movement. Powered operation, however, is relatively more complicated. To achieve effective operation, the drive system must drive the sliding door along the track in a reasonable time and provide enough force to overcome the elastomeric weather seal and the unlatched striker to assure proper closing of the sliding door. The drive system must also drive the sliding door through the change in direction of the curved guide rail. Although numerous effective powered drive systems are currently available, each is rather complicated and expensive to manufacture.

Accordingly, it is desirable to provide a powered drive system for a vehicle sliding door which is uncomplicated and cost effective.

SUMMARY OF THE INVENTION

The drive system according to the present invention drives a pulley along a curved track to open and close the sliding door. The pulley is pivotally mounted to the sliding door to permit the pulley to pivot during traverse of the curved portion of the track. A drive pulley transmits torque to the driven pulley through a drive belt.

In operation, as the driven pulley pivots during traverse of the curved portion of the track, the drive belt twists. Torque transfer between pulleys is maintained during twisting of the drive belt which thereby permits an uncomplicated yet effective system for driving the sliding door along the curved portion of track.

Another drive system according to the present invention transmits torque to the driven pulley through a drive shaft.

In operation, the drive shaft rotates about the shaft axis in concert with the driven pulley as the driven pulley traverses the curved portion of the track.

The present invention therefore provides a powered drive system for a vehicle sliding door which is uncomplicated and cost effective.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
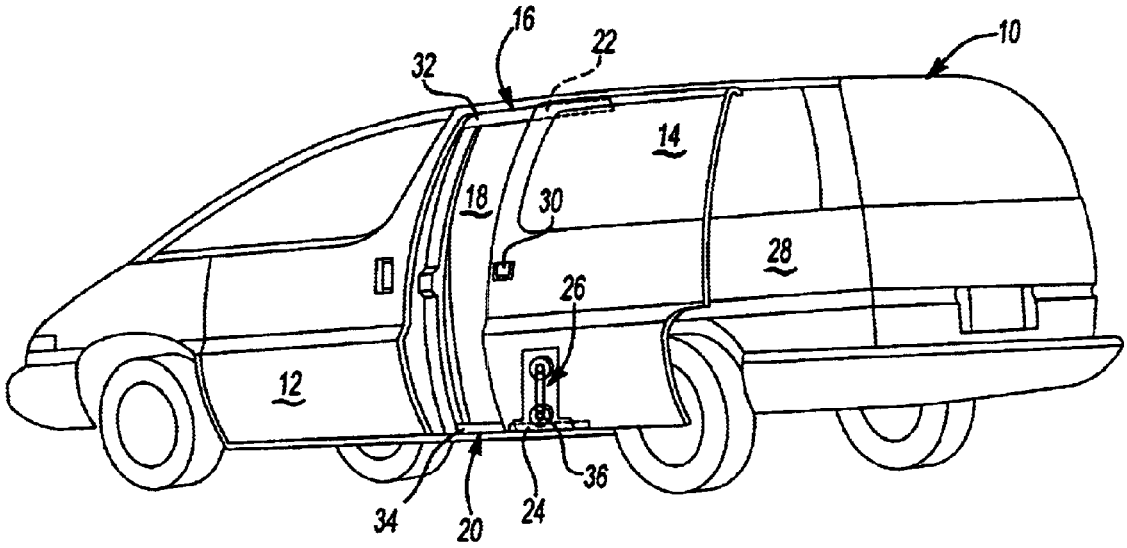
FIG. 1 is a general perspective view a vehicle for use with the present invention.

FIG. 1 illustrates a general perspective view of a vehicle 10 such as passenger van. Vehicle 10 includes a hinged front passenger door 12 and a sliding door 14. The sliding door 14 is supported and guided by an upper track 16 adjacent opening 18 and a lower track 20 adjacent opening 18. It should be understood that relative terms such as "upper" and "lower" are used with regard to the Figures for purposes of understanding and are not to be considered limiting.

An upper roller assembly 22 is attached to an upper forward corner of side door 14 and runs in upper track 16 that is at the top of the door opening. A lower roller assembly 24 is attached to the lower forward corner of side door 14 and runs in lower track 20 that is at the bottom of the side door opening. Operation of a sliding door for a van type vehicle is well known and need not be described in detail. Suffice it to say, drive system 26 drives the sliding door 14 between an open position and a closed position typically via a remote control or switch (not shown). The sliding door 14 moves inwardly (out of a plane parallel to a vehicle side wall 28) to a closed position for closing and sealing the side opening 18. A latch (illustrated schematically at 30) is provided at the front of the sliding door 14 to latch the door 14 in the closed position.

Out of plane movement of sliding door 14 is achieved by curving the forward ends 32, 34 of tracks 16, 20 toward the vehicle interior. It should be understood that various mechanisms allow the rear of sliding door 14 to move in and out of plane with the side of the vehicle prior to opening and after fully closing. Drive system 26 drives a pulley 36 along track 20 to open and close the sliding door. It should be understood that various pulley to track engagements will benefit from the present invention. Pulley 36 may replace or be provided in addition to roller assemblies 22,24. That is, the drive system 26 may be located in positions other than that shown. Furthermore, the drive system may alternatively or additionally be located on the vehicle 10 and drive the door 14. Preferably, the pulley 36 is pivotally mounted to the sliding door 14 at a pivot 37 (FIG. 2) to permit the pulley 36 to rotate during traverse of the curved portion 34 of track 20.

Figure 2:
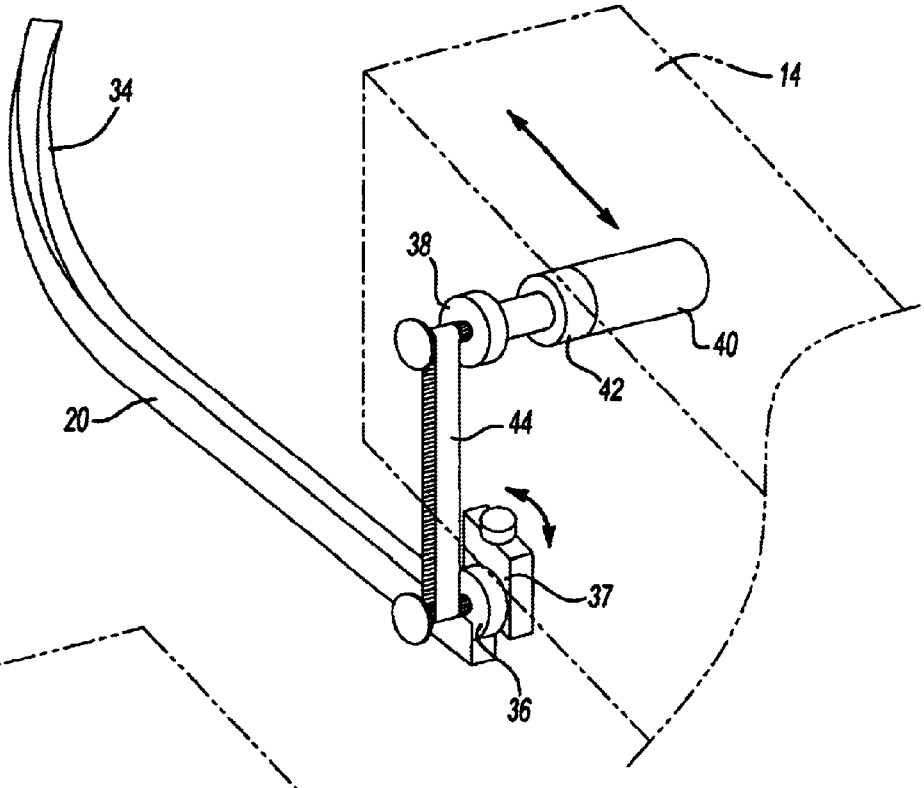
FIG. 2 is a perspective view of one embodiment of a sliding door drive system of the present invention.

Referring to FIG. 2, pulley 36 is remotely rotated by a driven pulley 38. Driven pulley 38 is preferably driven by an electric motor 40. The electric motor may directly drive pulley 38 or may do so through a gearbox (illustrated schematically at 42). Drive pulley 38 and pulley 36 are within a common plane when pulley 36 is located upon the straight section of track 20. With the exception of pulley 36, drive system 26 is preferably contained within sliding door 14.

Figure 3:
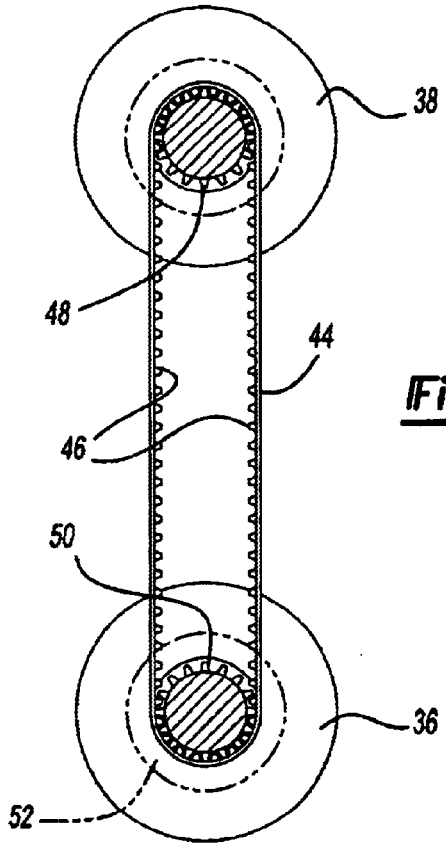
FIG. 3 is a schematic view of the drive system.

Drive pulley 38 transmits torque to pulley 36 through a drive belt 44. The drive belt 44 preferably includes a set of teeth 46 which engage corresponding teeth sets 48, 50 extending from pulleys 36 and 38 (FIG. 3). Slippage during torque transfer between pulleys 36, 38 is thereby minimized.

Figure 4:
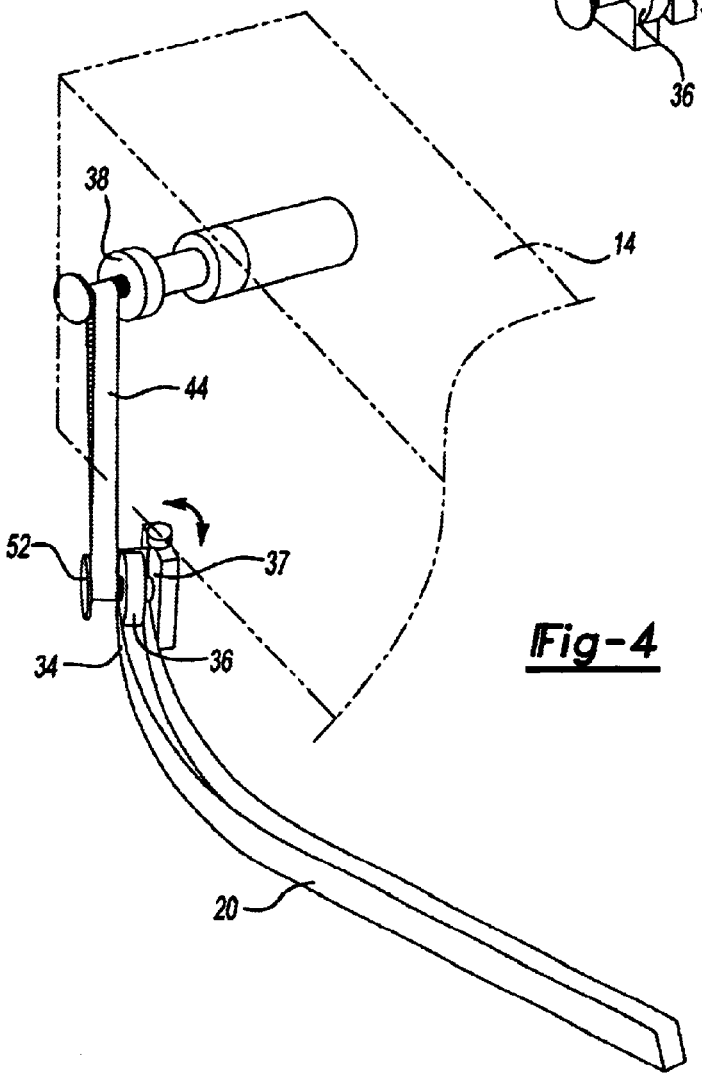
FIG. 4 is a schematic partially perspective view of a sliding door drive system of FIG. 2 in a second position.

In operation, as the pulley 36 pivots during traverse of the curved portion 34 of track 20, the drive belt 44 twists (FIG. 4). That is, the pulleys 36, 38 are not in the same plane. Preferably, a flange 52 extends from pulley 36 to minimize axial movement of drive belt 44. Torque transfer between pulleys 36, 38 is maintained during twisting of the drive belt 44 which thereby permits an uncomplicated yet effective system for driving the sliding door 14 along the curved portion 34 of track 20.

Figure 5:
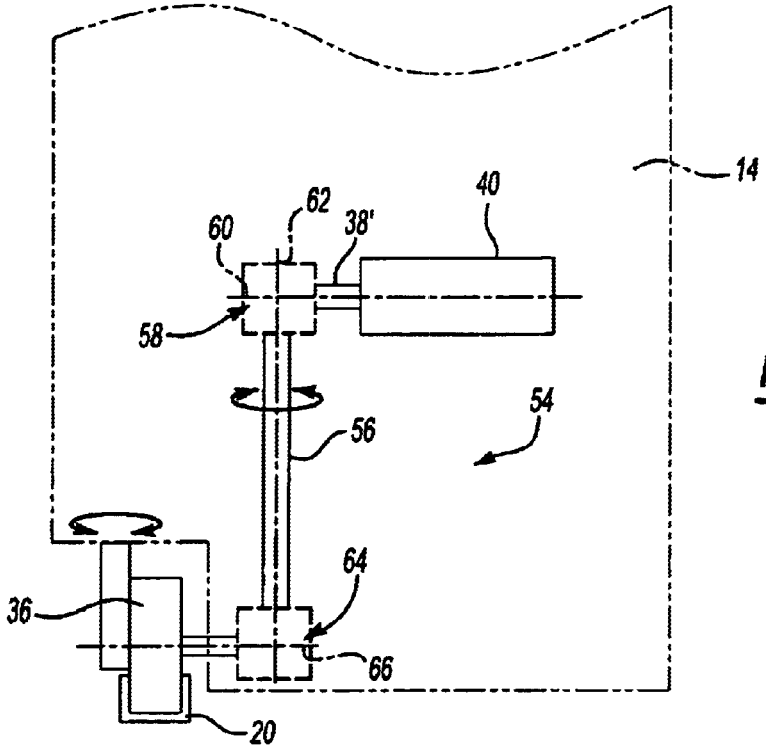
FIG. 5 is a schematic partially perspective view of another sliding door drive system of the present invention.
Figure 6:
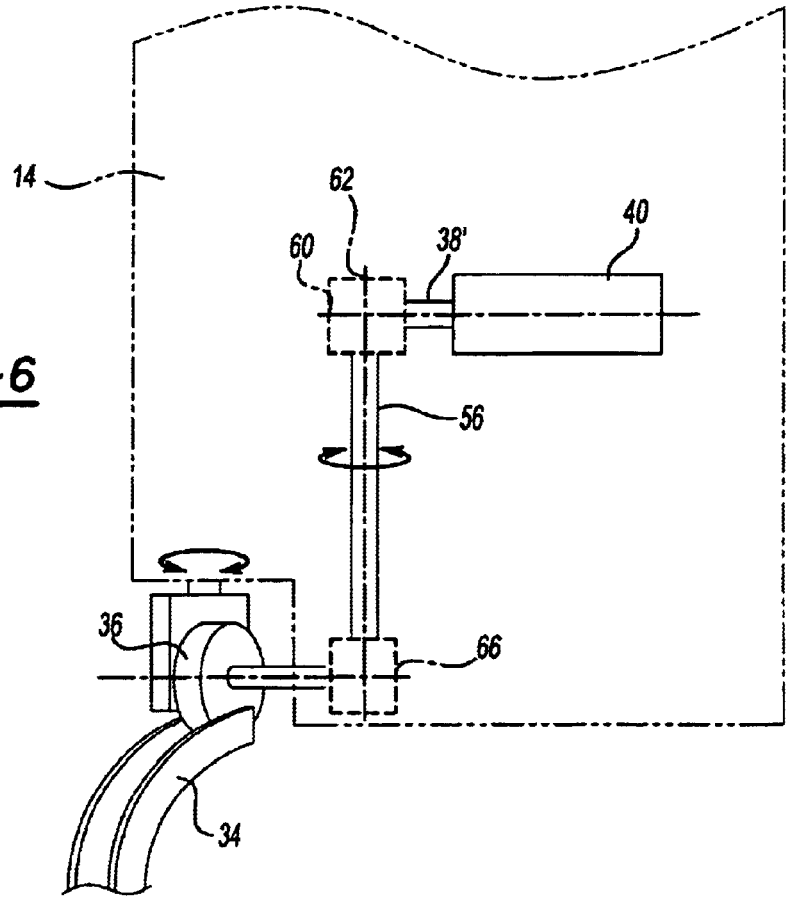
FIG. 6 is a schematic partially perspective view of the sliding door drive system of FIG. 5 in a second position.

Referring to FIG. 5, another drive system 54 is disclosed. A drive shaft 38' transmits torque to pulley 36 through a drive shaft 56. The drive shaft 38' is driven by an electric motor 40 as described above. A gear set (illustrated schematically at 58) driven by the drive shaft 38' transmits rotation from electric motor 40 about axis 60 to rotate drive shaft 56 about shaft axis 62. A second gear set (illustrated schematically at 64) converts rotation of drive shaft 56 about shaft axis 62 to rotation of pulley 36 about axis 66 (FIG. 6). Axis 60 and axis 66 are within a common plane unless pulley 36 is pivoted during traverse of the curved portion 34 of track 20.

In operation, as the pulley 36 rotates during traverse of the curved portion 34 of track 20, the drive shaft 56 rotates therewith as the drive shaft 56 is located within a common plane but perpendicular to track 20. That is, drive shaft 56 rotates about shaft axis 62 in concert with pulley 36 during traverse of the curved portion 34 of track 20.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A powered drive system for a sliding vehicle door comprising:

an electric motor;

a first pulley driven by said electric motor;

a second pulley drivable along a guide track comprising a curved track portion; and a drive mechanism between said first pulley and said second pulley to transmit torque from said first pulley to said second pulley, said drive mechanism at least partially twisting only as said second pulley pivots to traverse said curved track portion.

2. The powered drive system as recited in claim 1, wherein said second pulley is adapted to be pivotally mounted to the sliding vehicle door.

3. The powered drive system as recited in claim 1, wherein said guide track is adapted to be fixed to a vehicle including the sliding vehicle door.

4. The powered drive system as recited in claim 1, wherein said drive mechanism comprises a drive belt.

5. The powered drive system as recited in claim 4, wherein said first pulley, said second pulley and said drive belt are driven within a common plane, said drive belt only twisting out of said common plane in response to said second pulley traversing said curved track portion.

6. The powered drive system as recited in claim 4, further comprising a guide flange extending from said second pulley to retain said drive belt.

7. The powered drive system as recited in claim 4, wherein said drive belt is oriented generally perpendicular to said guide track.

8. A powered drive system for a sliding vehicle door comprising:

an electric motor;

a first pulley driven by said electric motor;

a second pulley drivable along a guide track comprising a curved track portion; and a drive belt between said first pulley and said second pulley to transmit torque from said first pulley to said second pulley, said drive belt at least partially twisting only as said second pulley traverses said curved track portion.

9. The powered drive system as recited in claim 8, wherein said second pulley is adapted to be pivotally mounted to the sliding vehicle door, said second pulley pivoting as said second pulley traverses said curved track portion and said guide track adapted to be fixed to a vehicle which includes the sliding vehicle door.

10. The powered drive system as recited in claim 8, wherein said drive belt includes a set of teeth which engage corresponding sets of teeth extending from said first pulley and said second pulley.

11. The powered drive system as recited in claim 8, further comprising a guide flange extending from said second pulley to retain said drive belt.

12. The powered drive system as recited in claim 8, wherein said first pulley, said second pulley and said drive belt are driven within a common plane, said drive belt twisting out of said common plane in response to said second pulley traversing said curved track portion.

13. The powered drive system as recited in claim 8, wherein said second pulley twists said drive belt in response to said second pulley traversing said curved track portion.

14. A powered drive system for a sliding vehicle door comprising:

an electric motor;

a first pulley driven by said electric motor;

a second pulley drivable along a guide track comprising a curved track portion; and a drive mechanism between said first pulley and said second pulley to transmit torque from said first pulley to said second pulley, said drive mechanism at least partially twisting only as said second pulley pivots to traverse said curved track portion, said drive mechanism includes a drive belt wherein said first pulley, said second pulley and said drive belt are driven within a common plane, said drive belt twisting out of said common plane in response to said second pulley traversing said curved track portion.

* * * * *